US005855509A

United States Patent [19]

White et al.

[11] Patent Number: 5,855,509

[45] Date of Patent: Jan. 5, 1999

[54] PAINT SPRAY BOOTH AND AIR SUPPLY ARRANGEMENT

[76] Inventors: William H. White, 41199 Coventry, Novi, Mich. 48375; Maximilian K. Carthew, 807 Medinah, Rochester Hills, Mich. 48309

[21] Appl. No.: 947,852

[22] Filed: Oct. 9, 1997

[51] Int. Cl.[6] ..... B05B 15/12

[52] U.S. Cl. ..... 454/52; 118/326; 55/385.2

[58] Field of Search ..... 454/50, 51, 52; 118/326; 55/385.2, 484

[56] References Cited

U.S. PATENT DOCUMENTS

| | | | |
|---|---|---|---|
| 4,034,659 | 7/1977 | Raider | 454/298 |
| 4,173,924 | 11/1979 | Bradshaw . | |
| 4,367,787 | 1/1983 | Bradshaw . | |
| 4,537,120 | 8/1985 | Josefsson . | |
| 4,621,187 | 11/1986 | Petro, Jr. . | |
| 4,653,387 | 3/1987 | Osawa et al. . | |
| 4,730,553 | 3/1988 | Osawa et al. . | |
| 4,840,116 | 6/1989 | Murakami et al. . | |
| 5,040,482 | 8/1991 | McGuire et al. . | |
| 5,153,034 | 10/1992 | Telchuk et al. . | |
| 5,456,023 | 10/1995 | Farnan . | |
| 5,480,349 | 1/1996 | Kolta . | |
| 5,512,017 | 4/1996 | Gore et al. . | |
| 5,634,975 | 6/1997 | Josefsson . | |
| 5,643,077 | 7/1997 | Ayer . | |

*Primary Examiner*—Harold Joyce
*Assistant Examiner*—Derek S. Boles
*Attorney, Agent, or Firm*—Brooks & Kushman PC

[57] ABSTRACT

A paint spray booth and air supply arrangement includes a main fan for blowing air and an air supply plenum in fluid communication with the main fan for receiving blown air therefrom. A support grid is positioned beneath the air supply plenum and includes a plurality of grid openings. A painting chamber is positioned beneath the support grid. A plurality of diffuser modules are positioned within the plurality of grid openings, respectively, for directing blown air from the air supply plenum in a substantially vertically downward direction through the painting chamber. Each diffuser includes an adjustment feature for selectively adjusting the speed of air directed therethrough. An apparatus is provided for individually adjusting the adjustment feature in each of the plurality of diffuser modules for creating areas of variable air speed through the painting chamber corresponding with each diffuser module while the diffuser modules being adjusted are supported on the support grid. Accordingly, the need is eliminated for removing the diffuser modules for individual adjustment.

19 Claims, 7 Drawing Sheets

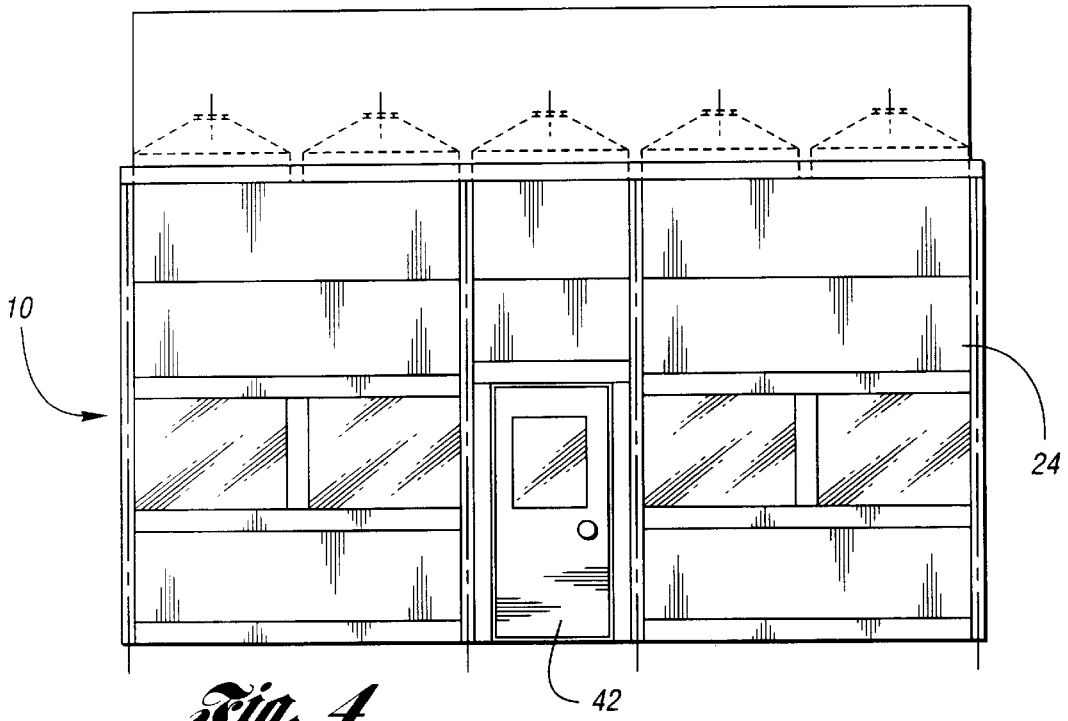
Fig. 4
Fig. 5
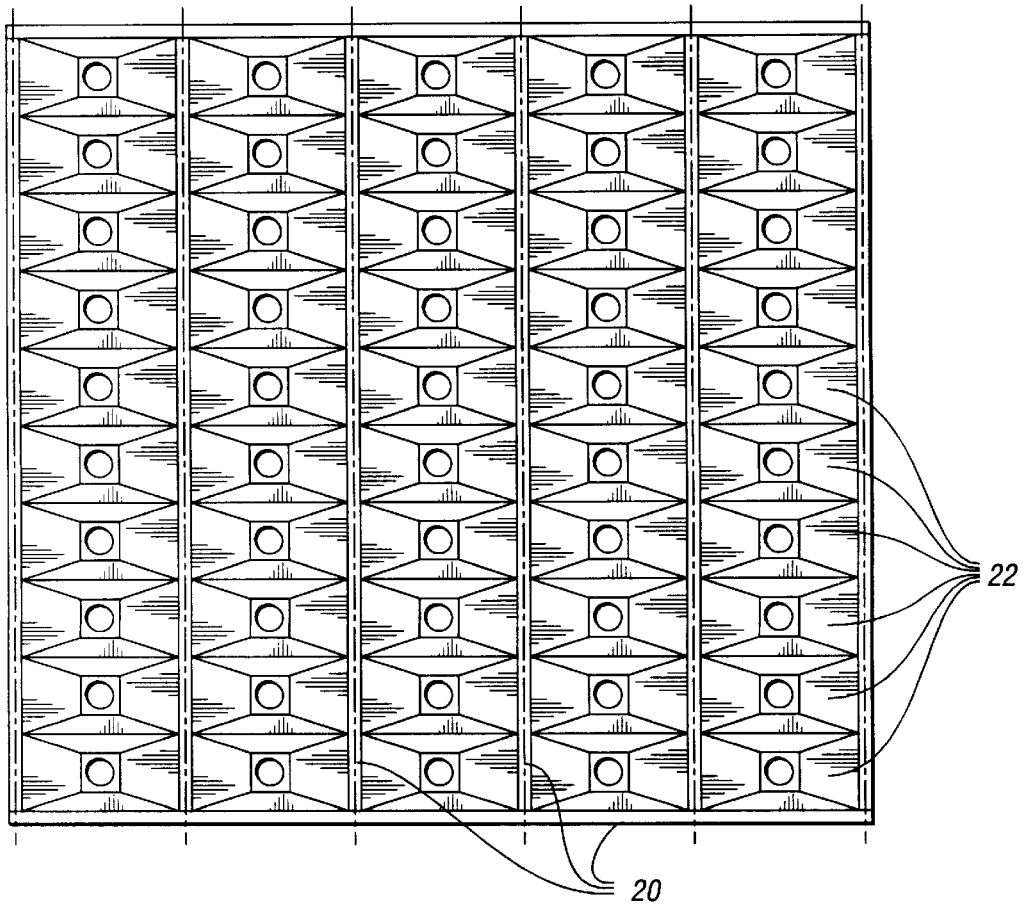

Fig. 9
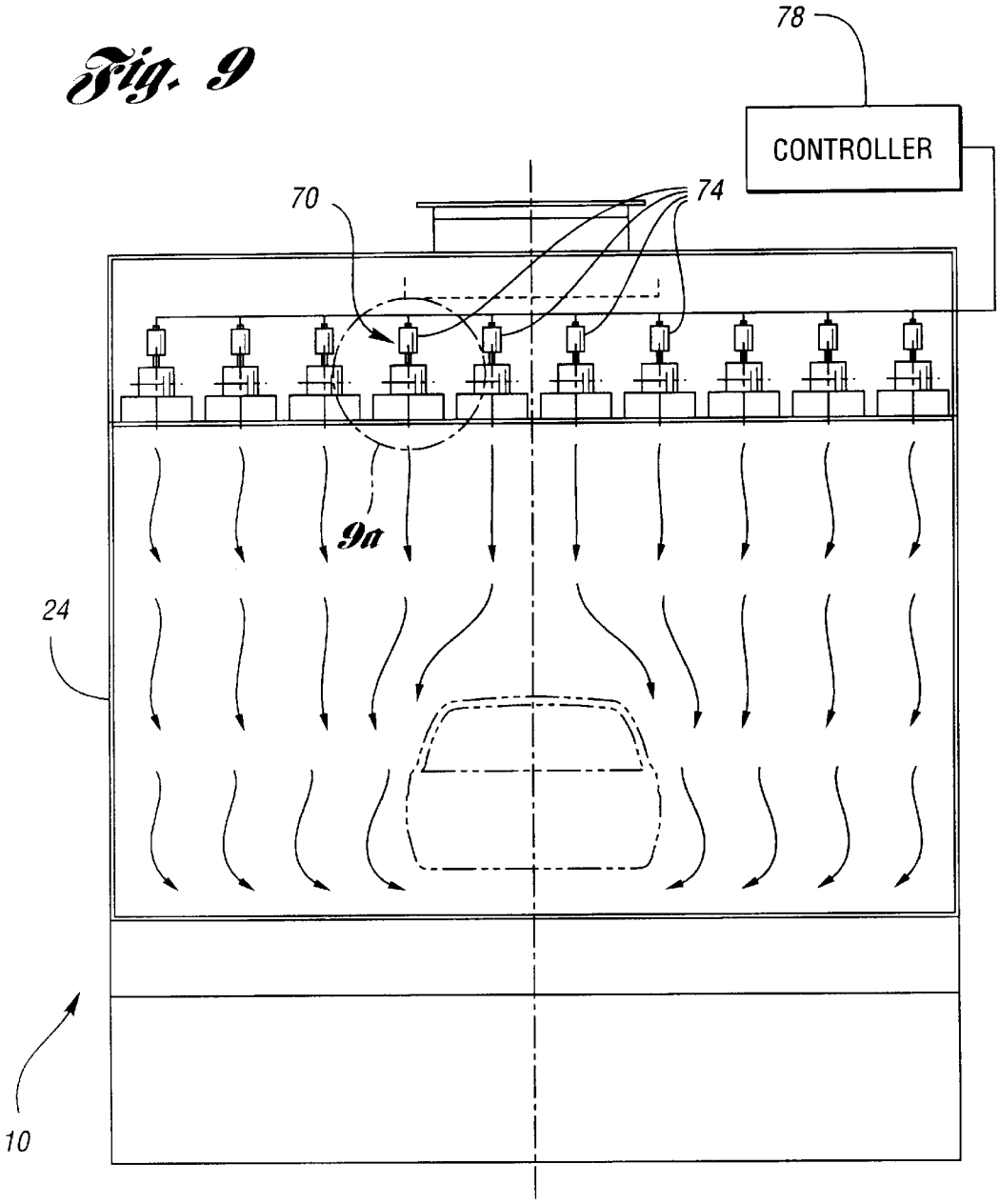
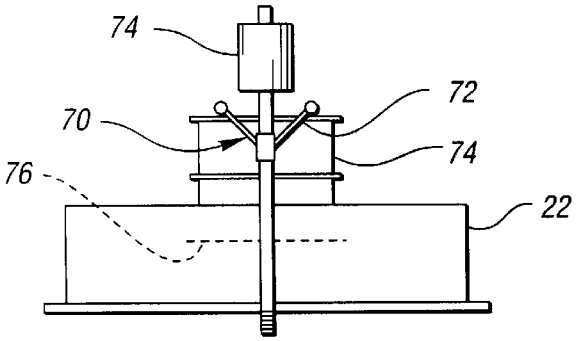
Fig. 9a

PAINT SPRAY BOOTH AND AIR SUPPLY ARRANGEMENT

TECHNICAL FIELD

The present invention relates to a paint spray booth and air supply arrangement, and more particularly to a spray booth in which air speed is individually controlled in different areas of the booth, and in which air speed may be individually adjusted without removing the diffuser modules from the ceiling of the booth.

BACKGROUND OF THE INVENTION

Paint spray booths are commonly found in production lines for vehicle bodies and parts. A vehicle body is transported through a paint spray booth where paint is applied to the body and subsequently dried. The paint may be applied by hand, or mechanically by automated equipment. During this painting process some of the paint may not be applied to the vehicle, but rather appears as overspray in the booth atmosphere. This overspray must be removed from the paint spray booth to keep it from falling back on the painted vehicle or from being inhaled by the operators of the equipment.

The paint overspray is typically removed by providing an air flow from a supply plenum above the paint spray booth, through the paint spray booth and out to gas scrubber equipment which removes paint particles from the exhaust gas. It is desirable to maintain the airflow passing over the vehicle being painted turbulance free. This ensures that the air flow does not disturb the uniform paint application to the vehicle. The minimizing of the air flow closely adjacent to the vehicle increases the transfer efficiency of the paint onto the vehicle body. High air flow volumes into that location have a tendency to disrupt the transfer efficiency of the paint being applied onto the vehicle body. Moreover, by reducing the air flow at the central portion the overall volume of the air is reduced. A portion of the air passing through the paint spray booth must be treated with a complicated solvent abatement process, and by reducing the air flow volume, the abatement requirements for cleaning the air are correspondingly reduced. At the same time, it is also desirable to keep the air flow passing over the painting equipment and operators at a higher velocity to prevent the equipment and operators from experiencing paint contamination. However, it is further desirable to minimize air flow in as many non-critical areas as possible in order to decrease energy consumption.

Existing spray booth designs envisage a certain predetermined air flow and flow distribution for the entire spray booth. The plenum has various dampers, diffusers, mixing plates, etc., to provide essentially smooth air flow through the spray zone at a fixed rate of flow. However, in practice, this is rarely achieved due to the non-standard configuration of the booth and the workpiece to be painted, and due to poor air flow design of such spray booths which often causes unwanted turbulence and nonlaminar air flow in critical areas of the spray booth. Poor spray booth air flow causes paint wastage by blowing paint particles in unwanted directions, and often away from the vehicle onto the floor, walls, operator, etc. This is a major cost penalty for manufacturers which are attempting to minimize paint usage and environmental impact.

It is common to have excess air flow in spray booths of up to 20 percent due to poor air supply control. This leads to a significant annual energy penalty for the user. Accordingly, it is desirable to provide a means for accurately and efficiently controlling air speed in various areas of the paint spray booth to optimize flow conditions in certain areas of the booth, and to minimize air flow in those areas in which flow is not required. In current systems, in order to adjust air flow in various areas of the spray booth, individual diffusers must be removed or accessed from above the ceiling for adjustment. This limitation significantly affects energy efficiency and painting performance of a particular spray booth. The performance of the booth is particularly affected by such limitations when the configuration of the article to be painted within the booth is changed, such as a change in car lines, which changes the air flow requirements around the article, which sometimes requires flow adjustment.

It is, therefore, desirable to provide a paint spray booth and air supply arrangement in which multiple air speed zones are provided, and in which air speed may be quickly adjusted without removing diffusers or adjusting them from above the spray booth ceiling.

DISCLOSURE OF THE INVENTION

The present invention overcomes the above referenced shortcomings of prior art paint spray booths by providing a paint spray booth which includes a plurality of diffuser modules positioned within openings formed in a support grid, wherein each diffuser module includes an adjustment feature for adjusting air flow therethrough, and the spray booth includes an apparatus for individually adjusting the adjustment feature in each of the diffuser modules without removing the diffuser modules from the support grid. The apparatus for individually adjusting the adjustment features of the diffuser modules may comprise an adjuster screw and elongated manual adjustment tool, or an electronic control circuit including a control unit electrically interconnected with each of the adjustment features for selectively individually adjusting air flow from each diffuser module. Accordingly, the present invention provides a system which produces the desired smooth, controlled air flow in all cases (i.e., new installations or retrofits) by using an adjustable ceiling diffuser/filter, and can be either manually or automatically controlled to provide different conditions within the spray zone. By locating the special diffuser at the exit point of the ceiling, poor air flow conditions are corrected before they enter the spray booth.

More specifically, the present invention provides a paint spray booth and air supply arrangement including a main fan for blowing air, and an air supply plenum in fluid communication with the main fan for receiving blown air. A support grid is positioned beneath the air supply plenum and includes a plurality of grid openings. A painting chamber is positioned beneath the support grid. A plurality of diffuser modules are positioned within the plurality of grid openings, respectively, for directing blown air from the air supply plenum in a substantially vertically downward direction through the painting chamber. Each diffuser includes an adjustment feature for selectively adjusting the speed of air directed therethrough. An apparatus is provided for individually adjusting the adjustment feature in each of the plurality of diffuser modules for creating areas of variable speed through the painting chamber corresponding with each diffuser module while the diffuser module being adjusted is supported on the support grid, thereby eliminating the need for removing the diffuser modules for individual adjustment.

Preferably, the apparatus for individually adjusting the adjustment feature includes an adjustment screw operatively connected with the adjustment feature of each control module and extending downwardly therefrom. An elongated manual adjustment tool is adapted for engagement with the adjuster screw from below the support grid for individual adjustment of the particular adjustment features. The adjuster screw preferably includes a graduated scale for displaying the adjusted diffuser position.

In another embodiment, the apparatus for individually adjusting the adjustment feature includes an electronic control circuit including a control unit electrically interconnected with each of the plurality of adjustment features for selectively individually adjusting air flow from each diffuser module. The adjustment feature of each diffuser module may comprise a speed control blower, a motor actuated butterfly valve, etc.

Accordingly, an object of the present invention is to provide an improved paint spray booth and air supply arrangement which allows smooth and controlled flow of air from a plurality of diffuser modules spaced across the ceiling of the spray booth wherein each diffuser module is adjustable without removal of the module from the ceiling.

Another object of the invention is to provide a paint spray booth and air supply arrangement in which air speed and individual flow areas in the booth are controllable by means of an elongated adjustment tool used for individually adjusting particular diffusers.

A further object of the invention is to provide a paint spray booth and air supply arrangement which includes an electronic control circuit including a control unit electrically interconnected with adjustment features on each diffuser module for selectively individually adjusting air flow from each diffuser module.

The above objects and other objects, features and advantages of the present invention are readily apparent from the following detailed description of the best mode for carrying out the invention when taken in connection with the accompanying drawings.

BRIEF DESCRIPTION OF THE DRAWINGS

FIG. 4 shows a side-view of the paint spray booth of FIG. 3;

FIG. 5 shows an overhead view of the ceiling of the paint spray booth shown in FIG. 3;

FIG. 9 shows a schematically arranged end-view of a paint spray booth and air supply arrangement in accordance with another alternative embodiment of the invention;

FIG. 9A shows an enlarged side-view taken from circle 9A of FIG. 9.

DETAILED DESCRIPTION OF THE PREFERRED EMBODIMENTS

Figure 1:
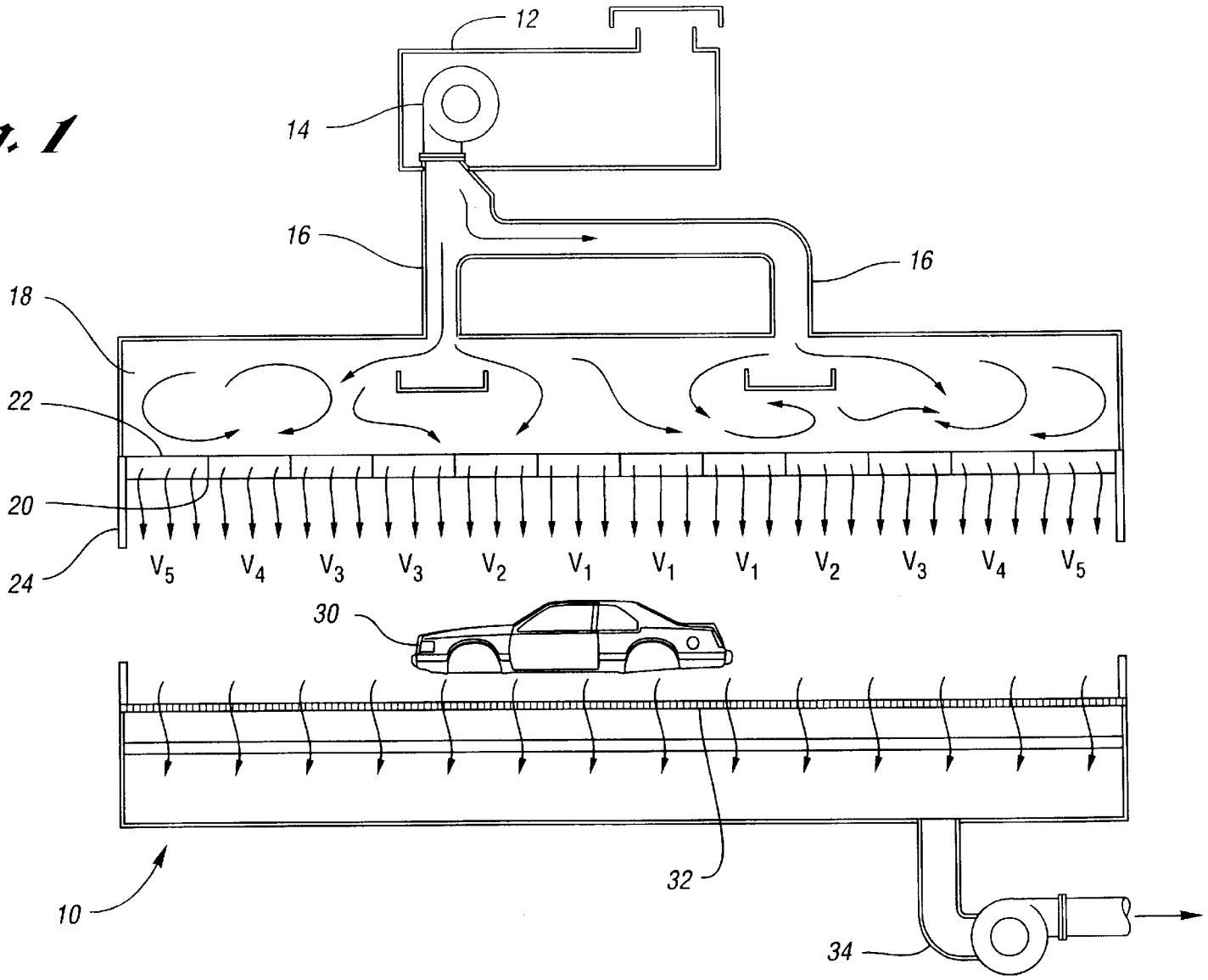
FIG. 1 shows a schematically arranged side-elevation view of a paint spray booth and air supply arrangement in accordance with the present invention.
Figure 2:
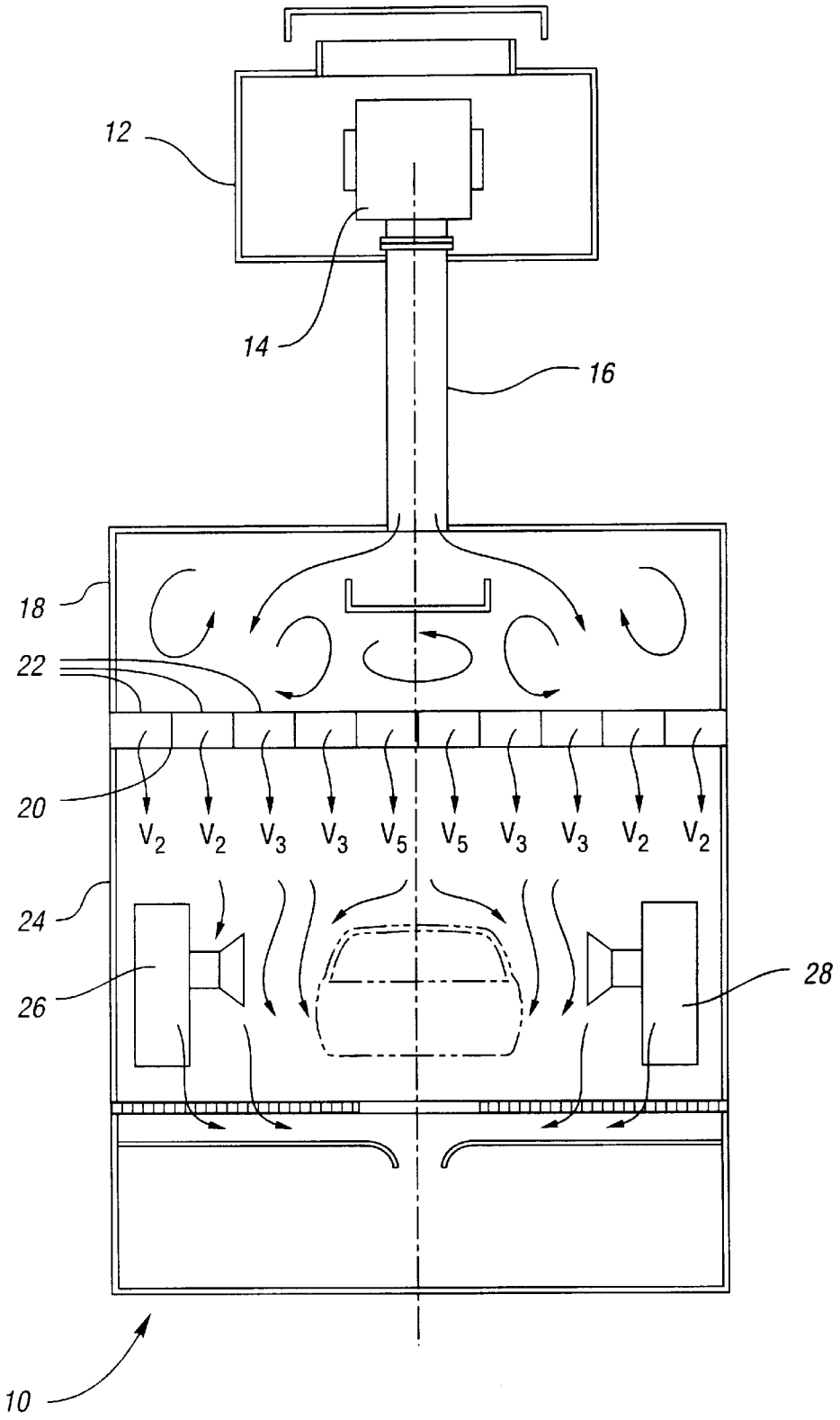
FIG. 2 shows a schematically arranged end-view of the paint spray booth and air supply arrangement of FIG. 1.

Referring to FIGS. 1 and 2, a schematically arranged elevational side-view and end-view of a paint spray booth and air supply arrangement 10 is shown in accordance with the present invention. An air supply housing 12 is provided with a main fan 14 for blowing air therefrom. Air supply ducting 16 carries the blown air to the air supply plenum 18. A support grid 20 (as more clearly shown in FIG. 6) is positioned beneath the air supply plenum 18 and forms a plurality of grid openings therein. A plurality of diffuser modules 22 (more clearly shown in FIG. 6) are supported within the plurality grid openings, respectively, formed in the support grid for directing blown air from the air supply plenum 18 in a substantially vertically downward direction through the painting chamber 24. As shown in FIG. 2, paint sprayers 26, 28 are provided within the painting chamber for spraying paint. As shown in FIG. 1, a vehicle body 30 may be transferred by means of a conveyor 32 through the painting chamber 24. The blown air is drawn through the bottom of the painting chamber by an exhaust fan system 34. FIGS. 1 and 2 illustrate the areas of variable air speed, V1, V2, V3, V4, and V5 created throughout the painting chamber 24 by the diffusers 22.

Figure 3:
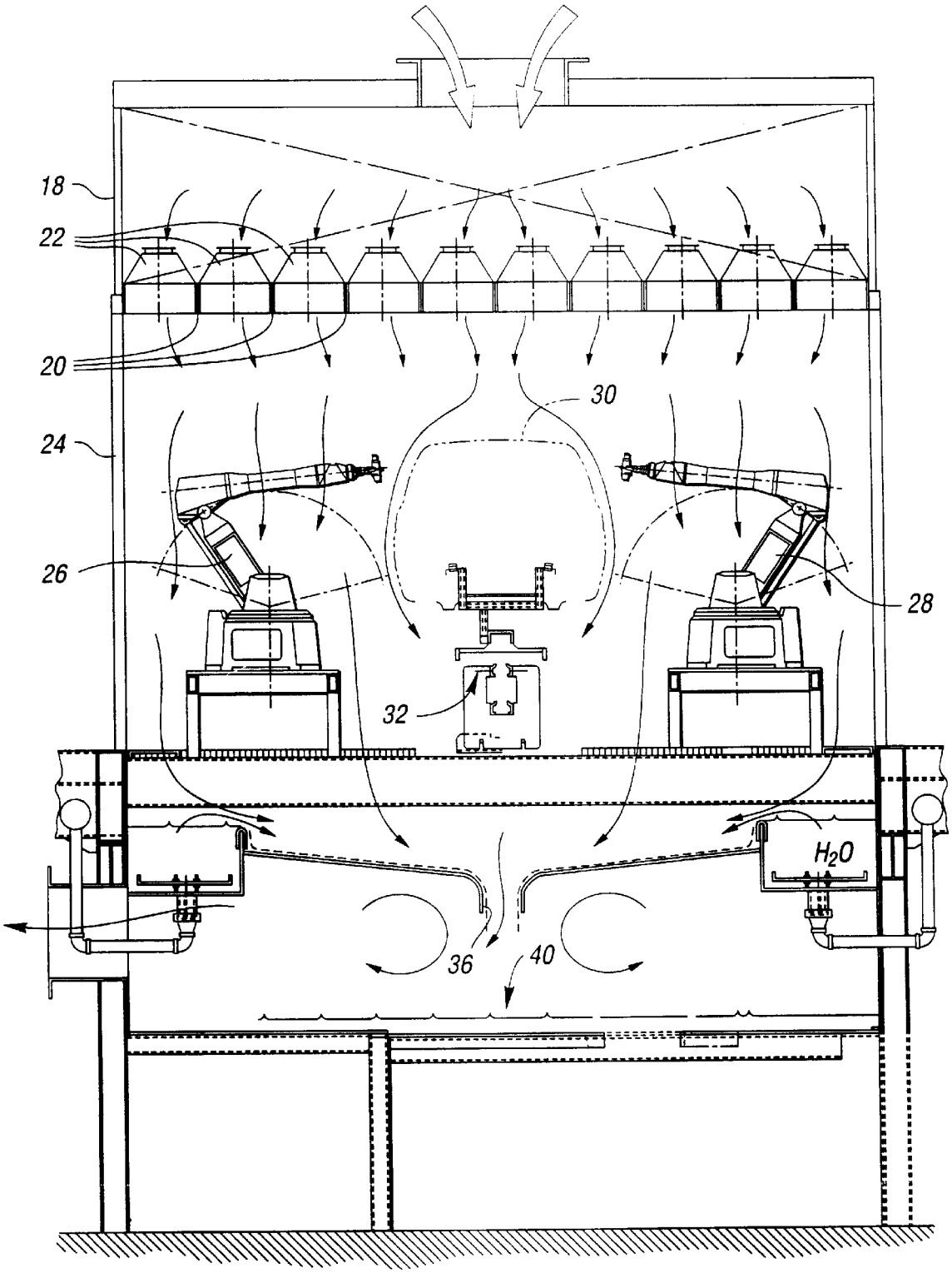
FIG. 3 shows an end-view of a paint spray booth and air supply arrangement in accordance with the present invention.

FIG. 3 is an end-view of such a paint spray booth and air supply arrangement 10 for painting a vehicle body 30. The support grid 20 is more clearly shown in FIG. 3, as well as the diffuser modules 22 which direct blown air from the air supply plenum 18 in a substantially vertically downward direction through the painting chamber, and ultimately through the venturi 36 at the bottom of the chamber, where paint is collected in the wet scrubber 40.

FIG. 4 shows a side-view of the paint spray booth and air supply arrangement 10 of FIG. 3, and includes a door 42 for operator entry. FIG. 5 shows an overhead plan view of the paint spray booth ceiling illustrating the support grid 20 and plurality of diffuser modules 22.

Preferably, each diffuser module 22 includes an adjustment feature for selectively adjusting the speed of air directed therethrough. Also, an apparatus is provided for individually adjusting the adjustment feature in each of the plurality of diffuser modules for creating the areas of variable air speed (V1, V2, V3, V4, and V5 shown in FIG. 1) through the painting chamber corresponding with each diffuser module while the diffuser modules being adjusted are supported on the support grid. Accordingly, this configuration eliminates the need for removing the diffuser modules for individual adjustment. One such embodiment is shown in FIGS. 6–8.

Figure 6:
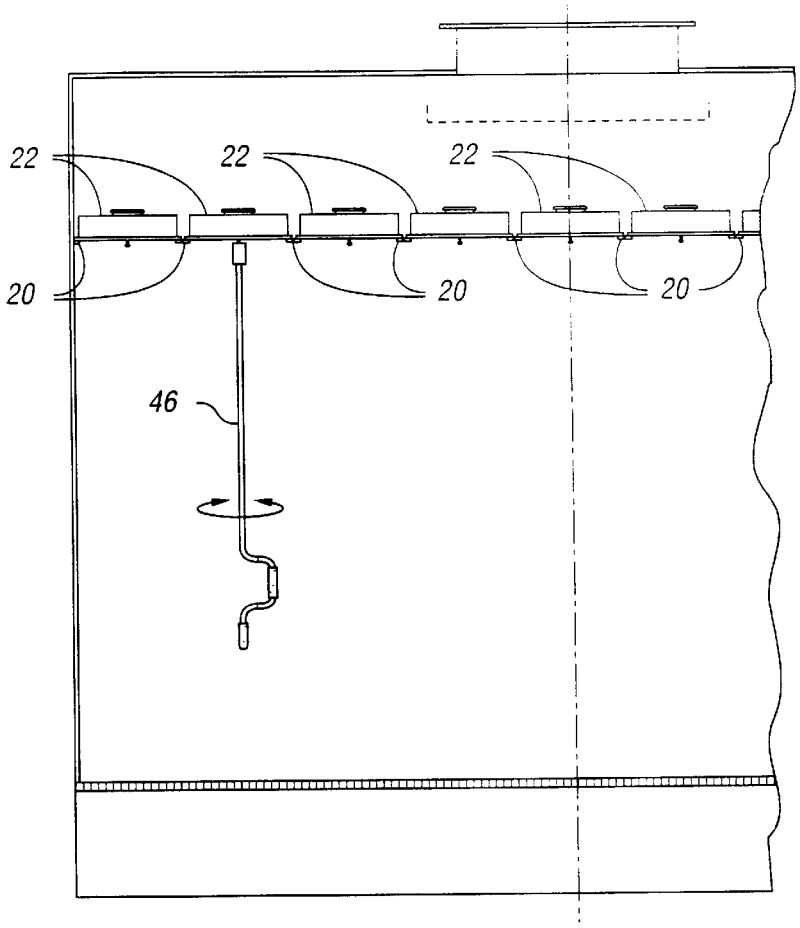
FIG. 6 shows a schematically arranged side-elevation view of a diffuser and a manual adjusting tool in accordance with a first embodiment of the invention.
Figure 7:
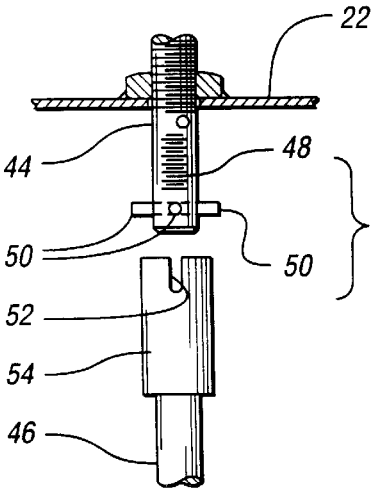
FIG. 7 shows an exploded cut-away view of an adjuster coupling and adjuster screw for use with the embodiment shown in FIG. 6.
Figure 8:
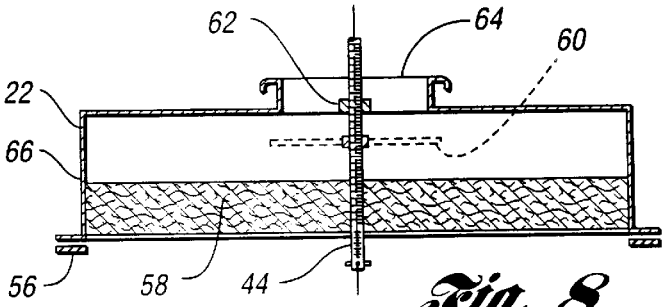
FIG. 8 shows a cross-sectional view of an adjustable diffuser module in accordance with the embodiment shown in FIG. 6.

In the embodiment shown in FIGS. 6–8, the apparatus for individually adjusting the adjustment feature comprises an adjuster screw 44 operatively connected with the adjustment feature of each control module and extending downwardly therefrom. An elongated manual adjustment tool 46, shown in FIG. 6, is adapted for engagement with the adjuster screw 44 from below the support grid 20 for individual adjustment of the various adjustment features. The adjuster screw 44 is operatively connected to an appropriate adjustment feature, such as that described below with reference to FIG. 9A, for adjusting the variable air speed flow rate through the diffuser. As shown in FIG. 7, the adjuster screw 44 includes various pins 50 extending therefrom for cooperation with a slot 52 formed in an adjuster coupling 54 attached to the end of the manual adjustment tool 46 for rotation of the adjustment screw 44. As shown in FIG. 7, the adjustment screw 44 preferably includes a graduated scale for displaying the adjusted diffuser position of the respective diffuser 22.

FIG. 8 shows a preferred embodiment of a diffuser module 22 which rests upon a neoprene gasket 56 on the support grid 20. The preferred diffuser module 22 is a clean room systems, TM-2 series disposable ceiling filter module available from American Air Filter Corporation of Louisville, Ky. As shown, dee design includes a pleated filter 58, and a diffuser/damper disc 60 for radially diffusing air flow. The pleated filter 58 provides long life, but other filters, such as a mat filter, may be used. The adjuster screw 44 is supported within a nylon bushing 62 and a bell-mouth inlet collar 64, which is provided on top of the module 22 for receiving air flow from the air supply plenum 18. The diffuser module 22 is enclosed within a sheet aluminum can 66.

Figure 8A:
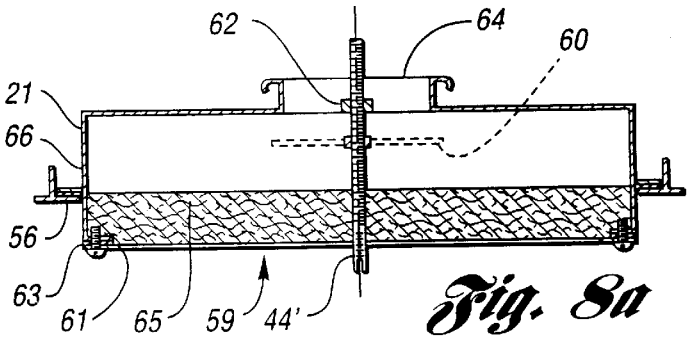
FIG. 8*a* shows a cross-sectional view of an adjustable diffuser module in accordance with an alternative embodiment of the invention.

FIG. 8*a* shows an alternative embodiment of a diffuser module 21 which incorporates a removable filter assembly 59, including a removable screen 61, seal 63, and filter 65. When the filter assembly 59 is removed the adjustment screw 44 remains in place. Accordingly, easy filter replacement is facilitated.

Referring to FIGS. 9 and 9A, a preferred adjustment feature is shown in accordance with the present invention. As shown, the adjustment feature 70 comprises a butterfly valve 72 which is actuated by a motor 74. The butterfly valve 72 operates within a cylinder 75 for selectively damping flow through the module 22. A diffuser disk 76 is provided for radially diffusing air flow. The apparatus for individually adjusting the adjustment feature 70 of each diffuser module 22 may comprise a control unit 78 electrically interconnected with each actuator motor 74 for selectively individually adjusting air flow from each diffuser module 22. Alternatively, the actuator motor 74 may drive a speed-controlled blower for varying the speed of air ejected from the diffuser modules 22.

Also, the apparatus for individually adjusting the adjustment feature 70 may comprise an adjustment screw extending downwardly from the diffuser module 22 and operatively connected to the butterfly valve 72 for adjustment of air flow through the diffuser module 22.

Figure 10:
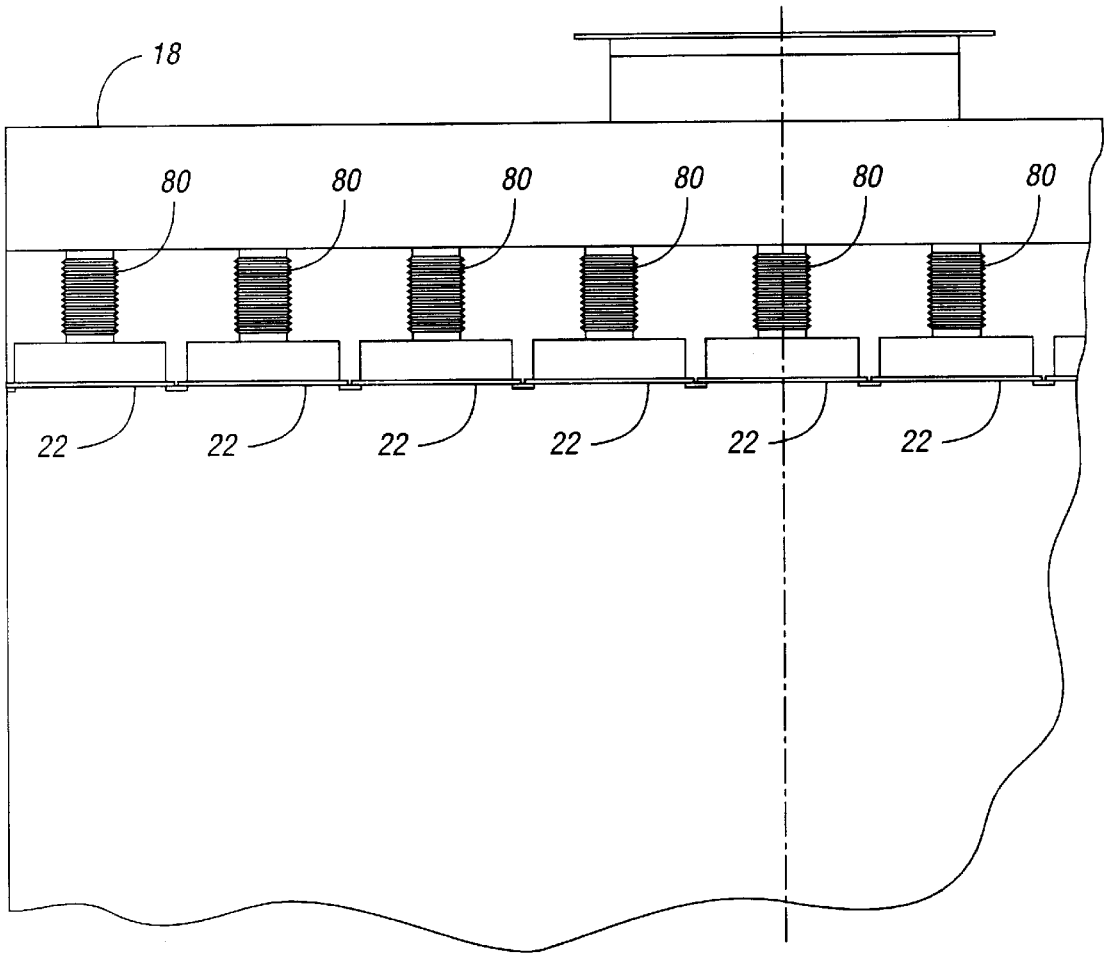
FIG. 10 shows a cut-away sectional view of a paint spray booth and air supply arrangement in accordance with a further alternative embodiment of the invention.

FIG. 10 shows a flexible air ducting arrangement 80 as an alternative air feed system for feeding air to the diffuser/filter modules 22. Various configurations are contemplated within the scope of the present invention.

Accordingly, the present invention achieves the stated objects by providing a paint spray booth and air supply arrangement which is nearly infinitely adjustable laterally and longitudinally across the spray chamber 24 for adjusting air speed flowing therethrough. An adjustment tool is provided for manually adjusting each diffuser adjustment feature from below. Alternatively, a controller is provided in electrical communication with a valve drive motor or speed-controlled blower motor for varying flow rates in the different diffusers as a vehicle body is transferred through the painting chamber for painting operations. The controller may be optimally programmed to minimize energy usage while optimizing flow conditions in the critical spray booth locations as the article to be painted is transferred to the booth, and as articles of differing surface configurations are transferred through the booth for painting.

While the best modes for carrying out the invention have been described in detail, those familiar with the art to which this invention relates will recognize various alternative designs and embodiments for practicing the invention within the scope of the appended claims.

What is claimed is:

1. A paint spray booth and air supply arrangement comprising:

a main fan for blowing air;

an air supply plenum in fluid communication with the main fan for receiving blown air therefrom;

a support grid positioned beneath the air supply plenum forming a plurality of grid openings;

a painting chamber positioned beneath the support grid;

a plurality of diffuser modules positioned within the plurality of grid openings, respectively, for filtering and directing blown air from the air supply plenum in a substantially vertically downward direction through the painting chamber, wherein each diffuser module includes an adjustment feature for selectively adjusting the speed of air directed therethrough, and a radical diffuser plate within each diffuser module;

an apparatus for individually adjusting the adjustment feature in each of the plurality of diffuser modules for creating areas of variable air speed through the painting chamber corresponding with each diffuser module while the diffuser modules being adjusted are supported on the support grid, thereby simplifying individual adjustment of the diffuser modules by eliminating the need for removing the diffuser modules or accessing the modules from above for individual adjustment.

2. The paint spray booth and air supply arrangement of claim 1, wherein each said diffuser module comprises a removable filter assembly.

3. The paint spray booth and air supply arrangement of claim 1, wherein said apparatus for individually adjusting the adjustment feature comprises an adjuster screw operatively connected with the adjustment feature of each control module and extending downwardly therefrom, and an elongated manual adjustment tool adopted for engagement with the adjuster screw from below the support grid for individual adjustment of the adjustment features.

4. The paint spray booth and air supply arrangement of claim 3, wherein the adjuster screw includes a graduated scale for displaying the adjusted diffuser position.

5. The paint spray booth and air supply arrangement of claim 2, wherein said apparatus for individually adjusting the adjustment feature comprises an electronic control circuit including a control unit electrically interconnected with each of the plurality of adjustment features for selectively individually adjusting air flow from each diffuser module.

6. The paint spray booth and air supply arrangement of claim 5, wherein each said adjustment feature comprises a speed-controlled blower for varying the speed of air ejected from the diffuser modules.

7. The paint spray booth and air supply arrangement of claim 5, wherein each said adjustment feature comprises a motor-actuated butterfly valve.

8. The paint spray booth and air supply arrangement of claim 1, wherein each of the plurality of diffuser modules includes a radial diffuser plate therein.

9. The paint spray booth and air supply arrangement of claim 1, further comprising a neoprene gasket positioned between each said diffuser module and the respective grid opening.

10. A paint spray booth and air supply arrangement, comprising:

a main fan for blowing air;

an air supply plenum in fluid communication with the main fan for receiving blown air therefrom;

a support grid positioned beneath the air supply plenum and forming a plurality of grid openings therein;

a painting chamber positioned beneath the support grid;

a plurality of diffuser modules positioned within the plurality of grid openings, respectively, for directing blown air from the air supply plenum in a substantially vertically downward direction through the painting chamber, wherein each diffuser includes an adjustment feature for selectively adjusting the speed of air directed therethrough, and a radial diffuser plate within each diffuser module;

a gasket positioned between each said diffuser module and the respective grid opening; and an apparatus for individually adjusting the adjustment feature in each of the plurality of diffuser modules for creating areas of variable air speed through the painting chamber corresponding with each diffuser module while the diffuser modules being adjusted are supported on the support grid, thereby simplifying individual adjustment of the diffuser modules by eliminating the need for removing the diffuser modules or accessing the modules from above for individual adjustment.

11. The paint spray booth and air supply arrangement of claim 10, wherein each said diffuser module comprises a pleated filter.

12. The paint spray booth and air supply arrangement of claim 10, wherein said apparatus for individually adjusting the adjustment feature comprises an adjuster screw operatively connected with the adjustment feature of each control module and extending downwardly therefrom, and an elongated manual adjustment tool adopted for engagement with the adjuster screw from below the support grid for individual adjustment of the adjustment features.

13. The paint spray booth and air supply arrangement of claim 12, wherein the adjuster screw includes a graduated scale for displaying the adjusted diffuser position.

14. The paint spray booth and air supply arrangement of claim 10, wherein said apparatus for individually adjusting the adjustment feature comprises an electronic control circuit including a control unit electrically interconnected with each of the plurality of adjustment features for selectively individually adjusting air flow from each diffuser module.

15. The paint spray booth and air supply arrangement of claim 14, wherein each said adjustment feature comprises a speed-controlled blower for varying the speed of air ejected from the diffuser modules.

16. The paint spray booth and air supply arrangement of claim 14, wherein each said adjustment feature comprises a motor-actuated butterfly valve.

17. The paint spray booth and air supply arrangement of claim 10, wherein each of the plurality of diffuser modules includes a radial diffuser plate therein.

18. The paint spray booth and air supply arrangement of claim 10, further comprising a neoprene gasket positioned between each said diffuser module and the respective grid opening.

19. A paint spray booth and air supply arrangement, comprising:

a main fan for blowing air;

an air supply plenum in fluid communication with the main fan for receiving blown air therefrom;

a support grid positioned beneath the air supply plenum forming a plurality of grid openings;

a painting chamber beneath the support grid;

a plurality of diffuser modules positioned within the plurality of grid openings, respectively, for directing blown air from the air supply plenum in a substantially vertically downward direction through the painting chamber, wherein each diffuser includes an adjustment feature for selectively adjusting the speed of air directed therethrough; and an apparatus for individually adjusting the adjustment feature in each of the plurality of diffuser modules for creating areas of variable air speed through the painting chamber corresponding with each diffuser module while the diffuser modules being adjusted are supported on the support grid, thereby simplifying individual adjustment of the diffuser modules by eliminating the need for removing the diffuser modules or accessing the modules from above for individual adjustment;

wherein said apparatus for individually adjusting the adjustment feature comprises an adjuster screw operatively connected with the adjustment feature of each control module and extending downwardly therefrom, and an elongated manual adjustment tool adapted for engagement with the adjuster screw from below the support grid for individual adjustment of the adjustment features.

* * * * *

UNITED STATES PATENT AND TRADEMARK OFFICE

CERTIFICATE OF CORRECTION

PATENT NO. : 5,855,509

DATED : January 5, 1999

INVENTOR(S) : William H. White, Maximilian K. Carthew

It is certified that error appears in the above-identified patent and that said Letters Patent is hereby corrected as shown below:

Column 6, Line 21 (Claim 1), delete "radical" and insert --radial-- therefor.

Signed and Sealed this

Sixth Day of April, 1999

*Attest:*

Q. TODD DICKINSON

*Attesting Officer*

*Acting Commissioner of Patents and Trademarks*